US008477980B2

(12) United States Patent
Li et al.

(10) Patent No.: US 8,477,980 B2
(45) Date of Patent: Jul. 2, 2013

(54) VEHICLE MICROPHONE ASSEMBLY IN TRIM PANEL

(75) Inventors: Chi Li, Farmington Hills, MI (US); Sara E. Veyo, Canton, MI (US); Justin Lee Healy, Canton, MI (US); Adam W. Hellar, Flatrock, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 290 days.

(21) Appl. No.: 13/033,161

(22) Filed: Feb. 23, 2011

(65) Prior Publication Data

US 2012/0213399 A1 Aug. 23, 2012

(51) Int. Cl.
*H04R 9/08* (2006.01)
*H04R 11/04* (2006.01)

(52) U.S. Cl.
USPC ..... 381/359; 381/365

(58) Field of Classification Search
USPC ..... 381/359, 365; 455/569.1
See application file for complete search history.

(56) References Cited

U.S. PATENT DOCUMENTS

| | | | | |
|---|---|---|---|---|
| 5,601,679 | A * | 2/1997 | Mulcahy et al. | 264/167 |
| 7,110,553 | B1 | 9/2006 | Julstrom et al. | |
| 8,009,845 | B2 * | 8/2011 | Sakurai et al. | 381/359 |
| 8,331,601 | B2 * | 12/2012 | Gratke et al. | 381/365 |
| 2006/0103172 | A1 | 5/2006 | Veen et al. | |
| 2009/0106029 | A1 | 4/2009 | DeLine et al. | |

OTHER PUBLICATIONS www.xoutpost.com, "Anyone Know What the Connector is For?" posted Feb. 11, 2007, © 2010 Xoutpost.com, 5 pages.

* cited by examiner

*Primary Examiner* — Brian Ensey
(74) *Attorney, Agent, or Firm* — Vichit Chea; Price Heneveld LLP

(57) ABSTRACT

A vehicle trim and microphone assembly includes a headliner having a substrate, a foam layer, and a surface cover covering the substrate and foam layer. The substrate has a hole that is covered by the surface cover. A bracket is secured to the substrate and a microphone installed in the bracket so that acoustic sound waves pass through the surface cover within the hole to be detected by the microphone.

20 Claims, 3 Drawing Sheets

VEHICLE MICROPHONE ASSEMBLY IN TRIM PANEL

FIELD OF THE INVENTION

The present invention generally relates to automotive vehicle microphone installations, and more particularly relates to a microphone assembly onto a vehicle interior trim panel such as a headliner.

BACKGROUND OF THE INVENTION

Automotive vehicles are increasingly being equipped with one or more microphones to detect sound waves which are then converted to current signals. Microphones are commonly employed to detect sound for speech recognition so that a driver can verbally communicate instructions to electronics such as for navigation and phone applications. Microphones are also employed to detect noise within the passenger compartment for anti-noise cancellation applications. The microphones may be mounted within discrete structures of the vehicle such as the rear view mirror housing and within trim panels such as the headliner. Conventional microphone mounting arrangements in the headliner typically involve providing a hole extending through the entire headliner and a bezel surrounding the microphone which extends through the hole. The bezels are typically large and may be unappealing and result in a microphone assembly that is visible within the passenger compartment.

It is therefore desirable to provide for a microphone assembly within a trim panel of a vehicle that is not readily viewable.

SUMMARY OF THE INVENTION

According to one aspect of the present invention, a vehicle trim panel and microphone assembly is provided. The assembly includes a supportive substrate having a hole extending therethrough and a surface cover covering the substrate and the hole. The assembly also includes a bracket connected to the substrate. The assembly further includes a microphone assembled to the bracket to detect sound waves passing through the surface cover within the hole.

According to another aspect of the present invention, a vehicle headliner and microphone assembly is provided. The assembly includes a supportive substrate having a hole extending therethrough and a surface cover covering the substrate and the hole. The assembly also includes a bracket connected to the substrate. The assembly further includes a microphone assembled to the bracket to detect sound waves passing through the surface cover within the hole.

According to a further aspect of the present invention, a method of assembling a microphone in a vehicle trim panel is provided. The method includes providing a trim panel having a supportive substrate and a surface cover, and forming a hole in the substrate such that the hole is covered by the surface cover. The method also includes the step of connecting a bracket to the substrate proximate to the hole. The method further includes the step of assembling a microphone to the brackets so that the microphone detects sound waves passing through the surface cover.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
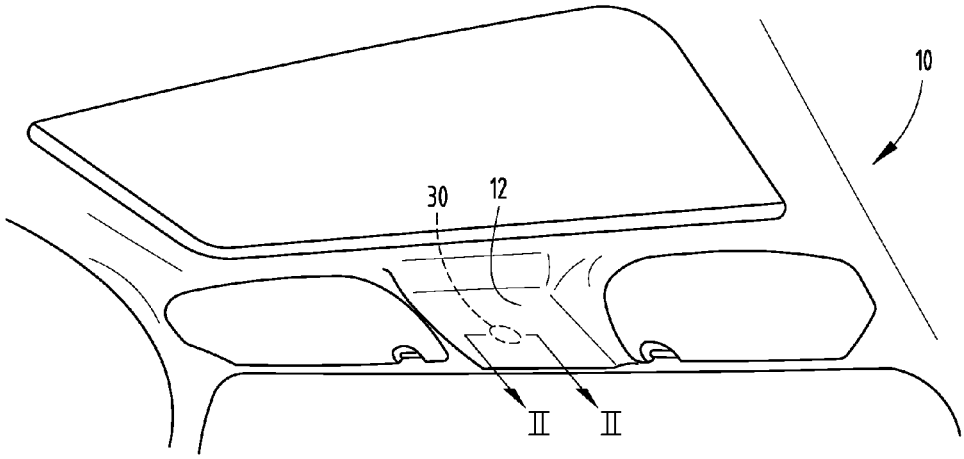
FIG. 1 is a perspective view of a portion of a headliner in a passenger compartment of a vehicle having a microphone assembly, according to one embodiment.

Referring now to FIG. 1, a trim panel in the form of a thermoset polyurethane headliner 12 is shown attached to the underside (visible side) of a roof of an automotive vehicle 10, generally covering a portion of the vehicle passenger compartment. The headliner 12 may have a conventional shape and may be installed to the underside of the vehicle roof with the use of fasteners and/or adhesives as is generally known in the art. The vehicle 10 may include any passenger vehicle including, but not limited to, a car, a truck, a van, a cross-over vehicle, a farm tractor with an enclosed cab, and a bus. The headliner 12 may have various components assembled thereto including one or more overhead consoles, lights, vents and control switches. The headliner 12 may be constructed of materials that are air and sound wave permeable to allow acoustical absorption and dampening of sound in a manner that provides lightweight and high strength properties.

Figure 2:
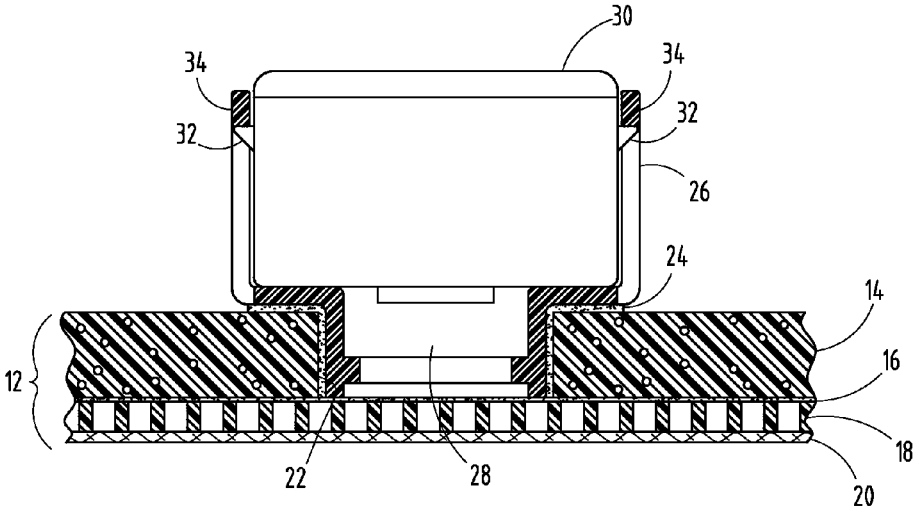
FIG. 2 is an enlarged cross-sectional view taken through line II-II of FIG. 1 illustrating the microphone assembly mounted in the headliner.
Figure 3:
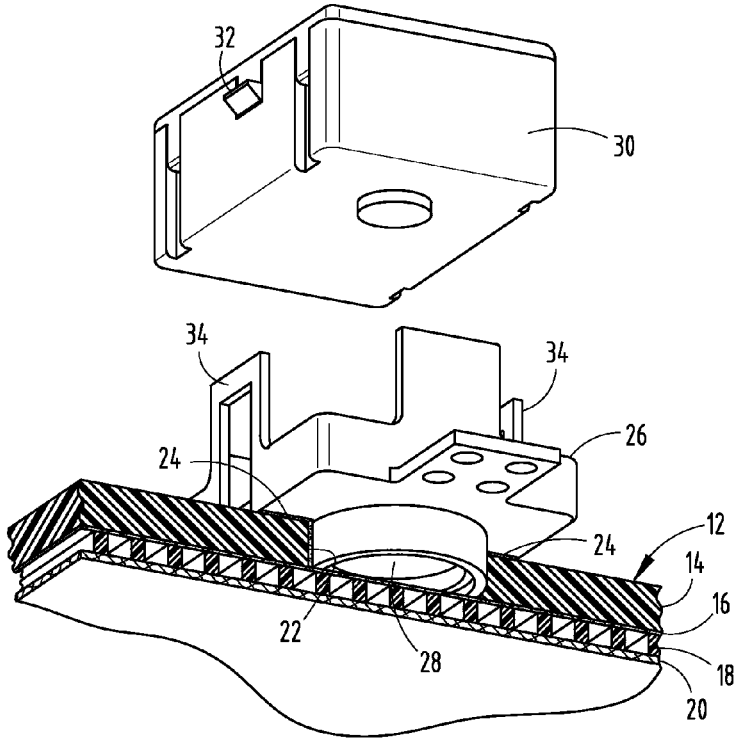
FIG. 3 is a partial exploded cut-away view of the microphone exploded from the bracket in the headliner, according to one embodiment.

As seen in FIGS. 1-3, the vehicle 10 is equipped with a vehicle trim panel and microphone assembly shown having a microphone 30 assembled to the vehicle headliner 12 such that the microphone 30 is hidden from view by passengers in the passenger compartment. The microphone 30 picks up and detects acoustic sound waves from within the passenger compartment and may be installed as a desired location such as forward of the driver of the vehicle. The headliner 12 is shown in FIG. 2 having a supportive substrate 14, an acoustically transparent open cell foam layer 18 adhered thereto by way of adhesive layer 16, and an acoustically transparent surface cover 20, according to one embodiment.

The supportive substrate 14 is sufficiently rigid to maintain a formed shaped and may be made of a semi-rigid polyurethane foam reinforced by fiber glass layers, according to one embodiment. According to another embodiment, the supportive substrate 14 may be made of a glass mat thermofoam (GMT) or a fiber mat thermoform (FMT) having a mat of polymer with fiber glass or polymer with reinforcing fiber. It should be appreciated that a combination of a GMT or FMT or polyurethane may be provided as the substrate 14, according to a further embodiment. The substrate could also be a cardboard construction with corrugated multi-layer paper materials, according to another embodiment. It should be appreciated that other supportive substrates may be employed according to various other embodiments. Supportive substrate 14 may have a thickness in the range of 2-15 mm, according to one embodiment.

The open cell foam layer 18 may include an open cell polyurethane foam which is acoustically transparent such that sound waves are capable of passing through the foam layer 18. Foam layer 18 may be adhered onto the bottom surface of substrate 14 via a thin (e.g., 0.1 mm) adhesive layer 16 which is acoustically transparent. A surface cover 20 is provided covering the bottom surface of the foam layer 18 and may include a fabric surface cover which may be laminated onto the foam layer 18 by heating the foam such that the foam partially melts and adheres to the surface cover 20, according to one embodiment. The surface cover 20 may be rolled onto the foam layer 18 subsequent or during the heating operation, according to one embodiment. The various layers of the headliner 12, including the substrate 14, foam layer 18 and surface cover 20 may be assembled in a mold, according to various molding embodiments.

The surface cover 20 forms the visible bottom surface of the headliner 12 which is visible to passengers in the vehicle 10. The surface cover 20 may include a woven fabric, according to one embodiment. According to another embodiment, the surface cover 18 may include a non-woven fabric. The surface cover fabric may include a flame laminated soft foam that has an open cell polyurethane which is also permeable to air and sound waves. The surface cover 18 has a substantially open air porosity so that air and sound waves, such as voice generated sound and noise, pass through the surface cover 18 with little or no resistance such that the surface cover 20 is acoustically transparent. According to a further embodiment, it should be appreciated that the surface cover 18 could be adhered directly to the supportive substrate 12, such as with an adhesive, absent the intermediary foam layer 18, according to another embodiment.

One or more of the various layers of the headliner 12 may be formed separate or together in a mold during manufacture. Following the molding of the trim part, the headliner 12 has a hole 22 that is milled therein such that the hole 22 extends completely through the substrate 14 but does not penetrate through the soft foam layer 18 and surface cover 20 as seen in the embodiment of FIG. 2. As such, the surface cover 20 covers the hole 22 in addition to covering the foam core layer 18 and the substrate 14. In the embodiment shown, the soft foam layer 18 covers the hole 22 and allows sound waves to pass therethrough. Both the soft foam layer 18 and surface cover 20 are acoustically transparent such that acoustic sound waves are able to pass therethrough into void space 28 provided in hole 22.

The vehicle trim panel and microphone assembly further includes a bracket 26 connected to the substrate 14 proximate to the hole 22. The bracket 26 has a shaped portion conforming to the shape of the substrate 12 and hole 22. Bracket 26 is assembled onto the substrate 14 such that the bottom shaped portion extends into the hole 22 and is glued thereto via adhesive layer 24. The bracket 26 has a receiver portion on top with flexible retention arms 34 for retaining a microphone 30. The microphone 30 is assembled onto the bracket 26 within the receiver portion and fastened or clipped thereto via retention arms 34 engaging toothed members 32 which extend from opposite side walls of the microphone 30. Accordingly, the microphone 30 may be easily assembled and snap-fit into place on the bracket 26 located on the top or backside of the headliner 12 and positioned within opening 28 to receive sound waves passing through the surface cover 20 and soft foam layer 18.

Figure 4:
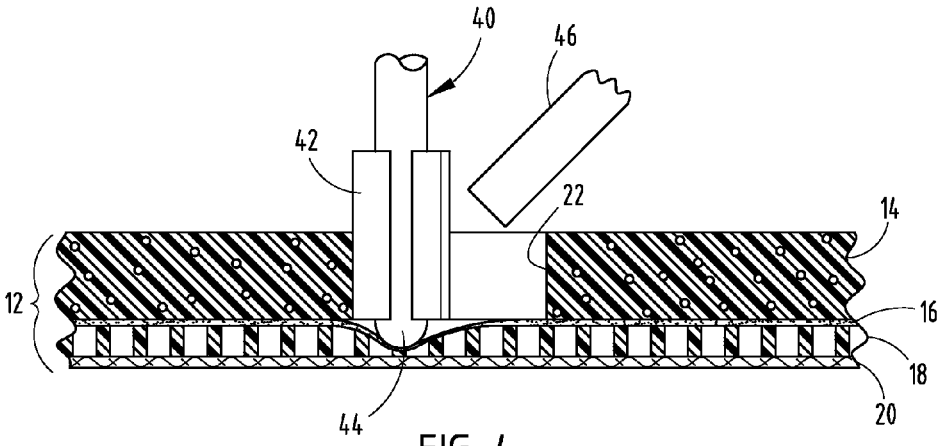
FIG. 4 is a side cut-away view of the headliner during a milling operation to form a hole in the substrate for mounting the microphone assembly, according to one embodiment.
Figure 5:
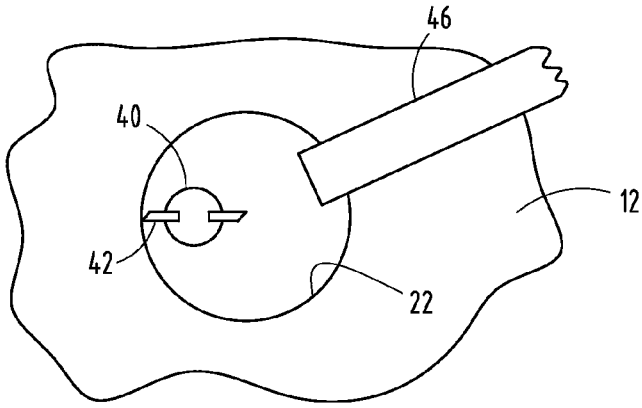
FIG. 5 is a top view of the headliner during the milling operation further illustrating the formation of the hole in the substrate.
Figure 6:
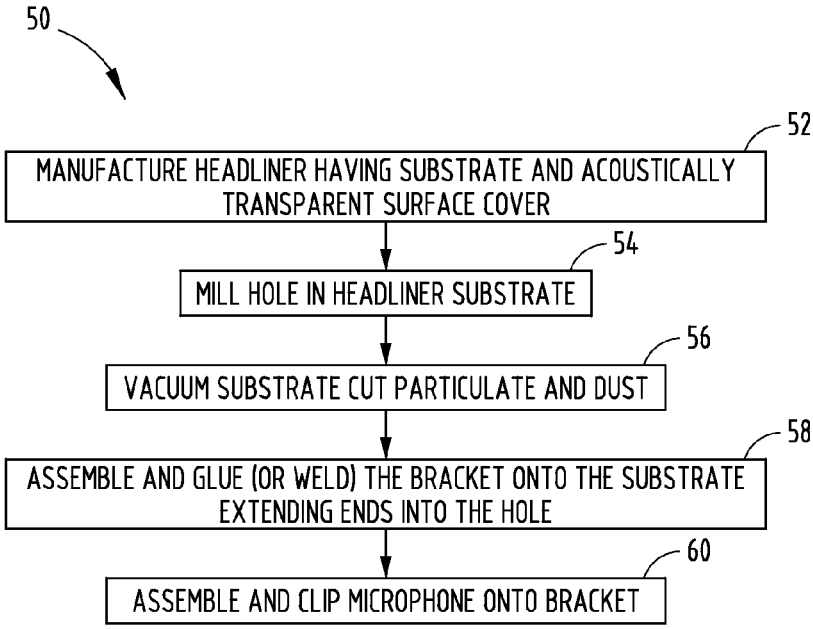
FIG. 6 is a flow diagram illustrating a method of assembling a microphone assembly in a vehicle headliner, according to one embodiment.

Referring to FIGS. 4-6, a method 50 of assembling a microphone 30 in the vehicle trim panel (e.g., headliner) 12 is illustrated, according to one embodiment. The method 50 includes step 52 of manufacturing a headliner 12 having a substrate 14 and an acoustically transparent surface cover 20. In one embodiment, the headliner 12 also has a soft foam layer 18 between substrate 14 and surface cover 20. Next, method 50 mills a hole 22 in the headliner substrate 14 in step 54. The hole 22 may be milled extending entirely through the substrate 14 as shown in FIGS. 4 and 5 using a mill or router bit 40 having cutting edges 42 on the side and a rounded tip 44 at the bottom end. Router bit 40 is rotated by a rotary device such as a router and extends into the substrate 14 with a force sufficient to cut a hole 22 in substrate 14 without damaging the surface cover 20. As the rounded bottom end 44 of drill bit 40 approaches the soft foam 18, the foam layer 18 is pushed downward such that the cutting edge 42 does not substantially cut the foam layer 18 nor the surface cover 20. The router bit 40 may be guided to cut out a desired area to form the entire hole 22 as shown in FIGS. 4 and 5.

Returning to FIG. 6, method 50 includes step 56 of vacuuming the headliner substrate milled pieces to pick up the cut particulate and dust with a vacuum machine 46 operated on top of substrate 14 proximate to hole 22. It should be appreciated that while the milling operation occurs or subsequent thereto, the vacuum machine 46 is operated to collect the debris including particulate resulting from the milling operation so as to form a clean hole 22. At step 58, method 50 proceeds to assemble and glue or weld the bracket 26 onto the substrate 14 such that the bottom shaped portion extends into the hole 22. Finally, the microphone 30 is assembled and clipped onto the bracket 26 at step 60. It should be appreciated that the microphone 30 may include wires that connect to one or more devices for power and signal communication.

While the trim panel and microphone assembly shown includes a microphone 30 assembled onto a headliner 14, it should be appreciated that the microphone 30 may be assembled to other trim panels, according to other embodiments. Additionally, it should be appreciated that one or more microphones 30 may be assembled to the trim panel which may include forming a plurality of holes in the substrate 14 and assembling a plurality of microphones 30. The microphone 30 may be useful for picking up sound waves for use with speech recognition applications (e.g., SYNC®) anti-noise cancellation applications and other applications. It should further be appreciated that various types of trim panels having a supporting substrate and an outer cover may be employed in connection with the assembly of the microphone 30.

Accordingly, the vehicle trim panel and microphone assembly and method provide for assembly of a microphone 30 to a trim panel 12 in a manner that hides the microphone 30 from view and is easy and cost affordable to assemble. The hidden microphone 30 advantageously picks up the acoustical sound waves passing through the surface cover 20 and provides an aesthetically pleasing appearance which achieves high craftsmanship.

It is to be understood that variations and modifications can be made on the aforementioned structure without departing from the concepts of the present invention, and further it is to be understood that such concepts are intended to be covered by the following claims unless these claims by their language expressly state otherwise.

We claim:

1. A vehicle trim panel and microphone assembly comprising:

a supportive substrate having a hole extending therethrough;

a surface cover covering a surface of the substrate and the hole;

a bracket connected to the substrate; and a microphone assembled to the bracket to detect sound waves passing through the surface cover within the hole, wherein the microphone does not extend beyond the surface of the substrate surface and is covered by the surface cover.

2. The assembly of claim 1, wherein the trim panel comprises a headliner.

3. The assembly of claim 1, wherein the bracket is adhered to the substrate.

4. The assembly of claim 1, wherein surface cover comprises a non-woven fabric.

5. The assembly of claim 4 further comprising a foam core layer disposed between the substrate and the surface cover.

6. The assembly of claim 5, wherein the foam core layer comprises an open cell foam.

7. The assembly of claim 1, wherein the substrate comprises polyurethane.

8. The assembly of claim 1, wherein the substrate comprises GMT.

9. A vehicle headliner and microphone assembly comprising:

a supportive substrate having a hole extending therethrough;

a surface cover covering a surface of the substrate and the hole;

a bracket connected to the substrate; and a microphone assembled to the bracket to detect sound waves passing through the surface cover within the hole, wherein the microphone does not extend beyond the substrate surface and is covered by the surface cover.

10. The assembly of claim 9, wherein the bracket is adhered to the substrate.

11. The assembly of claim 9, wherein the surface cover comprises a non-woven fabric.

12. The assembly of claim 11 further comprising a foam core layer disposed between the substrate and the surface cover.

13. The assembly of claim 12, wherein the foam core layer comprises an open cell foam.

14. A method of assembling a microphone in a vehicle trim panel comprising:

providing a trim panel having a supportive substrate and a surface cover which covers a surface of the substrate;

forming a hole in the substrate such that the hole is covered by the surface cover;

connecting a bracket to the substrate proximate to the hole; and assembling a microphone to the bracket so that the microphone detects sound waves passing through the surface cover, wherein the microphone does not extend beyond the surface of the substrate and is covered by the surface cover.

15. The method of claim 14, wherein the trim panel comprises a headliner.

16. The method of claim 14 further comprising the step of adhering the bracket to the substrate.

17. The method of claim 14, wherein the step of assembling the microphone comprises attaching the microphone to the bracket via a clip.

18. The method of claim 14, wherein the step of forming the hole comprises milling the hole with a router bit.

19. The method of claim 18, wherein the router bit has a rounded tip at one end and one or more cutting edges on a side.

20. The method of claim 18 further comprising the step of vacuuming particulate proximate the hole following or during the step of forming the hole.

* * * * *